United States Patent [19]

Herzig

[11] 4,363,193

[45] Dec. 14, 1982

[54] UNIVERSAL GRINDING MACHINE

[75] Inventor: Peter Herzig, Niederönz, Switzerland

[73] Assignee: Ewag A.G., Maschinen - und Werkzeugfabrik, Solothurn, Switzerland

[21] Appl. No.: 188,116

[22] Filed: Sep. 17, 1980

[30] Foreign Application Priority Data

Sep. 20, 1979 [CH] Switzerland ..... 8479/79

[51] Int. Cl.[3] ..... B24B 3/00; B23C 3/28; B23C 3/36

[52] U.S. Cl. ..... 51/48 HE; 409/77; 409/199

[58] Field of Search ..... 51/48 HE, 48 R, 36, 51/50 R, 56 R, DIG. 31, 219 R; 409/199, 77

[56] References Cited

U.S. PATENT DOCUMENTS 1,769,870 7/1930 Traud ..... 51/48 HE
2,718,097 9/1955 Bradley ..... 51/48 HE
3,119,305 1/1964 Chaffee et al. ..... 409/77
3,915,210 10/1975 McCord, Jr. ..... 51/48 HE
4,157,635 6/1979 Ward ..... 51/DIG. 31

*Primary Examiner*—Stephen G. Kunin
*Assistant Examiner*—Robert A. Rose
*Attorney, Agent, or Firm*—Oblon, Fisher, Spivak, McClelland & Maier

[57] ABSTRACT

During grinding, a grinding wheel effects movements of solely vertical displacement along a path parallel to a vertical guide rod. The workpiece to be machined is held by a rotatable, but not axially displaceable, chuck secured to a workpiece head. In order that helical relative movements between the workpiece and the grinding wheel may be produced, transmission components and gearing are provided for positively converting the vertical motion of the grinding wheel into rotary motion of the workpiece. For cylindrical and surface grinding, the motion-conversion arrangement may easily be disengaged or dismantled. Thus it is possible with this universal grinding machine to carry out drill grinding, cylindrical grinding, and/or surface grinding on a workpiece which need be chucked only once.

4 Claims, 3 Drawing Figures

FIG. 2
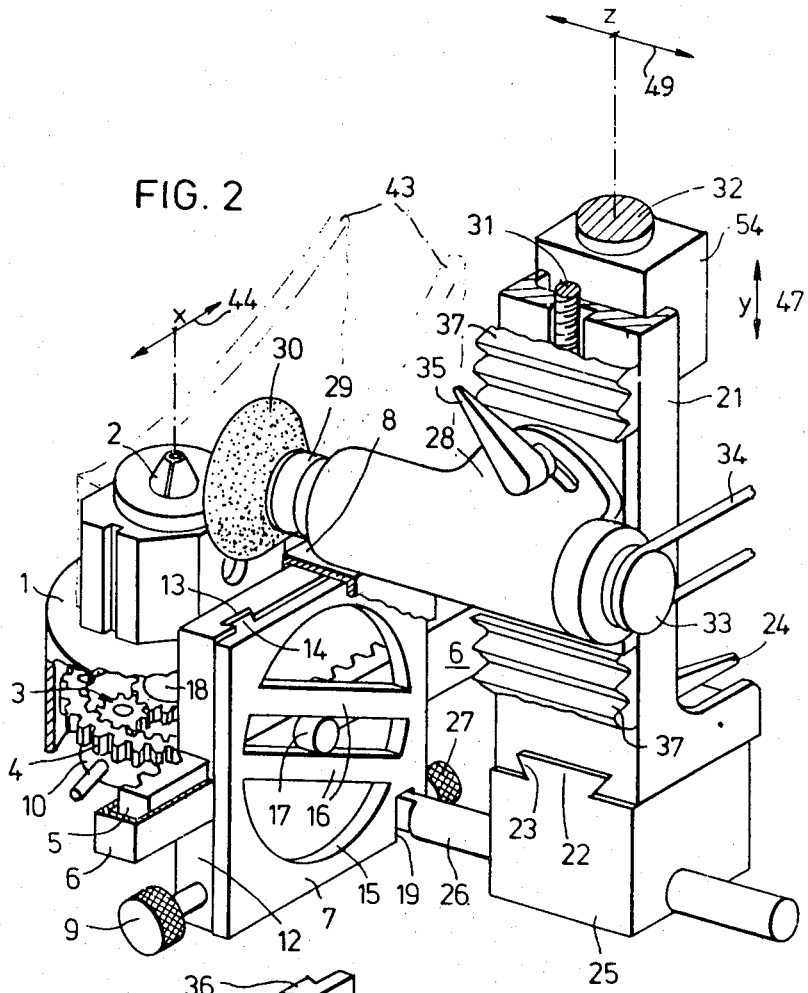
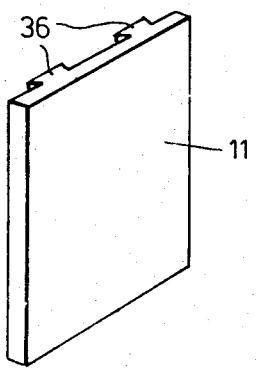
FIG. 3

UNIVERSAL GRINDING MACHINE

BACKGROUND OF THE INVENTION

This invention relates to grinding machines, and more particularly to universal grinding machines of the type having a holding device on which a workpiece head with a chuck is disposed, a grinding wheel secured to a grinding-wheel spindle, and a grinding-wheel spindle holder.

With prior art multi-purpose or universal grinding machines, it has not been possible to carry out drill grinding in addition to cylindrical grinding and surface grinding on the same machine. Thus, the grinding of a milling cutter, for example, has been possible only by using several machines to produce it, which also means that repeated rechucking is necessary. However, rechucking of a workpiece is in any case a potential source of error inasmuch as it may result in the well-known chucking errors, making the sure achievement of high and extremely high precision impossible despite precise tool guidance.

Workpieces are machined on prior art grinding machines with the aid of axial movements of the workpieces. Monitoring of the grinding operations by the operator is made more difficult by the simultaneous rotary and axial motion of the workpiece.

It is an object of this invention to provide a universal grinding machine which allows better monitoring of the grinding operations during cylindrical and drill grinding.

A further object of this invention is to provide a grinding machine with which surface grinding, cylindrical grinding, and/or drill grinding can be carried out on the same workpiece, chucked only once.

To this end, in the universal grinding machine according to the present invention, the grinding-wheel spindle holder is disposed for solely vertical displacement along a guide means, the chuck is rotatable about an axis, and means are provided for positive conversion of the vertical displacement motion of the grinding-wheel spindle holder into rotary motion of the chuck.

BRIEF DESCRIPTION OF THE DRAWINGS

A preferred embodiment of the invention will now be described in detail with reference to the accompanying drawings, in which:

FIG. 2 is a perspective view, partly broken away, of a workpiece head, a sine bar, a spindle support, and a cross slide detachably connected to the spindle support, and FIG. 3 is a perspective view of a cover plate which may be substituted for the sine bar.

DETAILED DESCRIPTION OF A PREFERRED EMBODIMENT

Figure 1:
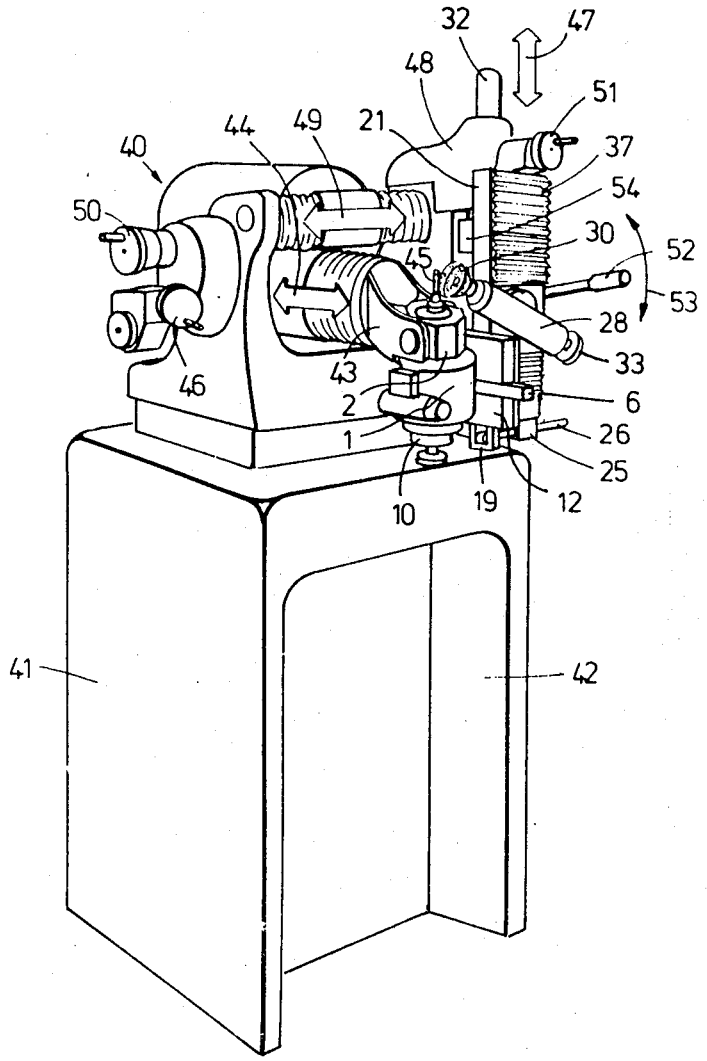
FIG. 1 is a perspective view of a universal grinding machine according to the invention.

FIG. 1 shows a grinding machine 40 mounted on a stand 41 which has a recess 42 at the front for accommodating the feet and knees of an operator sitting at the machine. During operation thereof, a workpiece head 2 is held rigidly by a holding device 43 which is horizontally displaceable in the direction indicated by arrow 44 for positioning a workpiece 45 to be machined. Holding device 43 is moved horizontally relative to a grinding wheel 30 by means of a handwheel 46. Grinding wheel 30 is secured to one end of a spindle 29 (FIG. 2) rotatably mounted in a grinding-wheel spindle holder 28. The drive of grinding-wheel spindle 29 will be described in more detail below.

As may be seen in FIG. 2, spindle holder 28 is detachably secured to a spindle support 21, which is in turn rigidly connected to the lower end of a vertical guide rod 32 by means of a block 54. As indicated by arrow 47, guide rod 32 is mounted for vertical displacement in direction y, but not for rotation, in a massive part 48 of grinding machine 40 (FIG. 1). For positioning grinding wheel 30 with respect to workpiece 45 in transverse direction z, indicated by arrow 49, part 48 is displaceable by means of a handwheel 50. Grinding wheel 30 is positioned in direction y by means of a further handwheel 51 and a vertical adjustment screw 31, partially visible in FIG. 2. Upon rotation of handwheel 51, spindle holder 28 is relatively displaced in direction y with respect to spindle support 21.

For causing grinding wheel 30 to effect vertical movements in direction y during grinding of workpiece 45, the operator moves spindle support 21 up and down with the aid of an operating lever 52. When lever 52 is operated as indicated by arrow 53, an up-and-down movement in vertical direction y is imparted to spindle support 21, guide rod 32, spindle holder 28, and grinding wheel 30.

The perspective view of FIG. 2 shows only those parts which are important for the invention. Workpiece head 1, including chuck 2 for a workpiece to be machined (not shown), is depicted as partly broken away to reveal a planetary gear 3 housed within. A gear rim 4 of gear 3 meshes with a rack 5 which is disposed for longitudinal displacement in a rack holder 12 connected rigidly to workpiece head 1. The face of rack holder 12 remote from workpiece head 1 includes two dovetail grooves 13 running vertically, only one of which is visible in FIG. 2. Two elongated dovetail tenons 14 matching grooves 13 project from the rear face of a sine bar 7 resting against the face of rack holder 12. Grooves 13 and tenons 14 form a vertical guide for sine bar 7, which can thus move up and down along this guide. In the center of sine bar 7 is a large aperture 15 traversed by two inclined, parallel bars 16 between which a roller 17 secured to rack 5 is situated. When, for example, as viewed in FIG. 2, sine bar 7 with bars 16 moves downward along the aforementioned vertical guide, rack 5 moves to the left, and vice versa. The displacement motion of rack 5 is converted via gear rim 4 into a rotary motion which is transmitted via planetary gear 3 to a shaft 18 connected rigidly to chuck 2.

With the aid of a friction clutch 10 affixed to the bottom of workpiece head 1, preferably a conical friction clutch, planetary gear 3 can be disengaged. The disengagement of gear 3 makes it possible to drive shaft 18 by means of a motor (not shown) so that the grinding machine can be used for cylindrical grinding.

To protect rack 5 and sine bar 7 from grinding dust, these two parts are provided with covers 6 and 8, respectively, only partially visible in FIG. 2.

Grinding wheel 30 is affixed to one end of grinding-wheel spindle 29 which is mounted rotatingly, but not axially displaceably, in spindle holder 28. At the other end of spindle 29 is a V-belt wheel 33 connected to a drive motor (not shown) by a V-belt 34, shown only in part. Spindle holder 28 is pivoted on spindle support 21. By means of a bolt lever 35, the angular position between spindle holder 28 and spindle support 21 can be fixed. By pivoting spindle holder 28 relative to spindle support 21, the clearance angle of grinding wheel 30 with respect to the workpiece (not shown) can be adjusted.

The solely vertical movements of spindle support 21 during grinding are effected manually by means of operating lever 52 and are transmitted via a cross slide 25 and a connecting rod 26 to sine bar 7. One end of rod 26 is held in a cutout 19 in sine bar 7 by a bolt 27, while the other end passes through cross slide 25. Projecting from the top of cross slide 25 is a dovetail tenon 22 which slides in a matching groove 23 of spindle support 21. By means of a bolt lever 24, the relative positions of spindle support 21 and cross slide 25 can be fixed.

Cross slide 25 makes it possible for spindle support 21 to effect movements in directions x and z relative to connecting rod 26 and sine bar 7. After positioning, bolt lever 24 is tightened so that there can be no displacement between spindle support 21 and cross slide 25.

During drill grinding of a workpiece, e.g., a helical milling cutter, spindle support 21 is moved up and down by means of operating lever 52. This up-and-down motion is transmitted to the rotating grinding wheel 30, on the one hand, and to sine bar 7 via cross slide 25 and connecting rod 26, on the other hand. The inclined bars 16 of sine bar 7 convert the vertical motion, together with roller 17, into horizontal motion of rack 5. Rack 5 meshes with gear rim 4 of planetary gear 3 and converts the horizontal motion into rotary motion of shaft 18, so that the workpiece clamped in chuck 2 necessarily rotates with the vertical movement of grinding wheel 30, the workpiece not being moved axially. The result is a helical relative movement between the workpiece and grinding wheel 30.

The lead of the helical movement is a function of the transmission ratio of planetary gear 3 and the angle of inclination of bars 16. In order to be able to vary this lead, it is preferable for the inclination of bars 16 to be adjustable. If bars 16 are inclined toward the other side, the result is a left-handed helical relative movement between the workpiece and grinding wheel 30.

For cylindrical grinding, the circular motion of the planet pinions of planetary gear 3 is released by disengaging friction clutch 10. Shaft 18 thereby becomes freely rotatable, and with the aid of the above-mentioned drive motor the workpiece can be caused to rotate independently of the up-and-down movement of grinding wheel 30.

For surface grinding, planetary gear 3 is disconnected and shaft 18 is locked. In addition, connection rod 26 is released from sine bar 7 by withdrawal of bolt 27, thereby eliminating the motion connection between sine bar 7 and spindle support 21 so that the latter, together with guide rod 32, can move in directions x or y. With the grinding machine described above, drill grinding, cylindrical grinding, and surface grinding can be carried out on a workpiece which need be inserted only once in chuck 2 and is held thereby. No rechucking of the workpiece is necessary, so that the various types of grinding can be carried out with extremely high precision.

In order to protect the unused sine bar 7 from grinding dust during cylindrical and/or surface grinding, sine bar 7 can easily be detached from rack holder 12 beforehand and replaced by a cover plate 11, illustrated in FIG. 3. For this purpose, cover plate 11 includes two elongated dovetail tenons 36 to be slid into grooves 13 of rack holder 12 in place of tenons 14 of sine bar 7. Once inserted, cover plate 11 is held in place by a stop screw 9.

With the grinding machine described above, unlike prior art grinding machines, the workpiece does not move axially but only rotatingly, or not at all. The exact positioning of grinding wheel 30 is achieved through vertical adjustment screw 31, by means of which grinding-wheel spindle holder 28 can be displaced relative to spindle suport 21 after loosening of bolt lever 35. At the same time, the clearance angle of grinding wheel 30 relative to the workpiece can be adjusted. Both positions can then be fixed by means of bolt lever 35.

The grinding movement of grinding wheel 30 is determined by the vertical guide and is therefore solely vertical. The construction described above enables the operator to work in a sitting position, thus allowing sure and accurate operation. If a microscope is used for checking the work, it can be secured directly and free of vibration to workpiece head 1 for accurate repetition.

For protecting screw 31 and the sliding surface of spindle support 21, the latter part and cross slide 25 are enclosed in a protective bellows 37.

What is claimed is:

1. A universal grinding machine comprising:

a workpiece holding means including a workpiece head provided with a rotatable chuck, a grinding-wheel spindle having a grinding wheel secured thereto, a vertically displaceable grinding-wheel spindle holder, guide means associated with said grinding-wheel spindle holder, and motion-conversion means associated with said grinding-wheel spindle holder and with said chuck, said grinding-wheel spindle holder being disposed for solely vertical displacement along said guide means, and said motion-conversion means being arranged to effect positive conversion of vertical displacement motion of said grinding-wheel spindle holder into rotary motion of said chuck, wherein said motion-conversion means comprise a planetary gear housed within said workpiece head and including a gear rim, a rack meshing with said gear rim, a vertically displaceable sine bar, a roller secured to said rack and engaging said sine bar, means for vertical guidance of said sine bar, and a rod detachably connected at one end to said sine bar and at the other end of said grinding-wheel spindle holder, whereby said vertical displacement motion of said grinding-wheel spindle holder is transmitted to said sine bar.

2. The grinding machine of claim 1, wherein said motion-conversion means further comprise a friction clutch for engaging and disengaging said planetary gear, whereby the mode of operation of said grinding machine can be changed from cylindrical grinding to drill grinding or vice versa.

3. The grinding machine of claim 1, further comprising a vertically displaceable spindle support connected to said grinding-wheel spindle holder, a cross slide connected to said spindle support and to said other end of said rod, and means for vertical guidance of said spindle support.

4. The grinding machine of claim 3, wherein said sine bar and said cross slide are detachably connected to one another by said rod for surface grinding.

* * * * *